US006070564A

United States Patent [19]

Hiraoka et al.

[11] Patent Number: 6,070,564

[45] Date of Patent: Jun. 6, 2000

[54] ACCESSORY DRIVE FOR OUTBOARD MOTOR

[75] Inventors: Noriyoshi Hiraoka; Takayuki Sato, both of Hamamatsu, Japan

[73] Assignee: Sanshin Kogyo Kabushiki Kaisha, Hamamatsu, Japan

[21] Appl. No.: 09/256,983

[22] Filed: Feb. 24, 1999

[30] Foreign Application Priority Data

Feb. 27, 1998 [JP] Japan ..... 10-061953

[51] Int. Cl.[7] ..... F02B 77/14

[52] U.S. Cl. ..... 123/198 R; 123/198 C; 123/509; 123/195 P; 440/900

[58] Field of Search ..... 123/198 R, 198 C, 123/195 P, 196 W, 495, 509; 440/900

[56] References Cited

U.S. PATENT DOCUMENTS

| | | | |
|---|---|---|---|
| 5,830,021 | 11/1998 | Takahashi et al. | 440/88 |
| 5,943,996 | 8/1999 | Sogawa et al. | 123/509 |
| 5,967,112 | 10/1999 | Haga et al. | 123/196 W |

*Primary Examiner*—Noah P. Kamen
*Assistant Examiner*—Hai Huynh
*Attorney, Agent, or Firm*—Knobbe, Martens, Olson & Bear LLP

[57] ABSTRACT

An outboard motor having a direct cylinder fuel injection system with a high-pressure pump that is driven directly from the engine crankshaft. This drive is positioned on the crankshaft above the flywheel at the upper portion of the engine, with other accessories being driven from the crankshaft below the flywheel, while still at the top of the engine. This facilitates servicing of the components and places them all in easily accessed locations.

16 Claims, 4 Drawing Sheets

ACCESSORY DRIVE FOR OUTBOARD MOTOR

BACKGROUND OF THE INVENTION

This invention relates to an outboard motor and more particularly to an improved accessory drive for an outboard motor.

As is well known, the power head of an outboard motor is quite compact in nature and does not afford a large amount of space for the powering engine and numerous accessories which may be driven by the engine. Some of these accessories perform functions in connection with the actual engine operation and other accessories may be utilized for other purposes which may include engine operation. However, the driving and positioning of these accessories is quite complicated by the small space that is available within the power head.

In order to improve the performance of the engines employed in outboard motors, it has been proposed to utilize direct cylinder fuel injection. Such direct injection systems generally require higher pressure pumps than utilized with normal manifold type fuel injection systems. This is because the fuel must be injected at a pressure higher than that in the combustion chamber which is considerably higher than atmospheric pressure present in the induction systems where conventional manifold injectors inject.

Therefore, in addition to all of the other conventional or desirable optional accessories, it is necessary to provide and drive a high pressure pump to elevate the fuel to the pressure required by the injectors. Because of the high pressures required, the high pressure pump generally requires an engine drive rather than electrically operated fuel pump, as may be employed with lower pressure fuel injection system.

This generally requires the driving of the high pressure pump directly from the engine crankshaft, which already is employed for driving other accessories, as aforenoted. Furthermore, because of the vertical disposition of the crankshaft in outboard motor applications, the placement of the accessory drives presents problems not present in more conventional engine applications where the engine output shaft rotates about a horizontal axis.

Generally, it is the practice to position the flywheel for the engine at the upper end of the crankshaft so as to facilitate starting and location of the starter motor and other components. However, this leaves little room for additional accessory drives such as a drive for a high pressure fuel pump for a fuel injection system. Also, this latter accessory may be an optional accessory depending upon the specific engine and injection system utilized.

That is, a same basic engine configuration may utilize in some applications with direct cylinder injection and in other applications having manifold injection. Thus, it is desirable if the same engine crankshaft and flywheel assembly can be utilized by both specific engine applications. However, this gives rise to the problem in positioning of the high pressure pump drive for the direct fuel injected version of the engine.

It is, therefore, a principal object of this invention to provide an improved accessory drive for an outboard motor.

It is a further object of this invention to provide an improved high pressure fuel pump drive for an outboard motor that is driven off of the crankshaft.

It is a yet further object of the invention to provide an improved and compact flexible transmitter drive arrangement for engine accessories with engines utilized in outboard motors and wherein certain of the accessories are driven above the flywheel while others are driven below the flywheel.

SUMMARY OF THE INVENTION

This invention is adapted to be embodied in an outboard motor having a power head containing a powering internal combustion engine, a driveshaft housing and lower unit depending from the power head and containing a driveshaft, transmission and propulsion device for propelling an associated watercraft and which are all driven by the engine. The engine is mounted in the power head so that the crankshaft rotates about a vertically extending axis. A flywheel is affixed to the upper end of the crankshaft within the power head. A high pressure pump is driven off of the crankshaft at a point above the flywheel while another engine accessory is also driven off of the crankshaft at the upper end of the engine but below the flywheel.

View A shows the engine and certain systems associated with it.

View B is a rear elevational view of the upper portion of the outboard motor with the protective cowling removed and with the engine shown partially in cross-section.

View C is a side elevational view of the outboard motor.

Figure 1A:
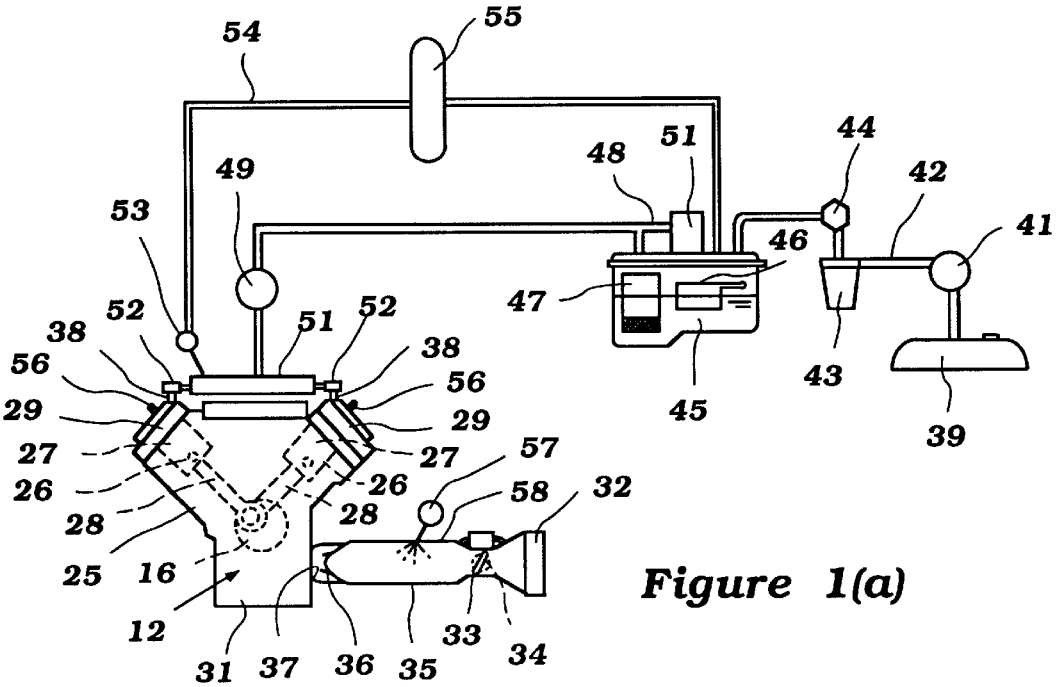
FIG. 1 is a three part view showing an outboard motor and components thereof.
Figure 1B:
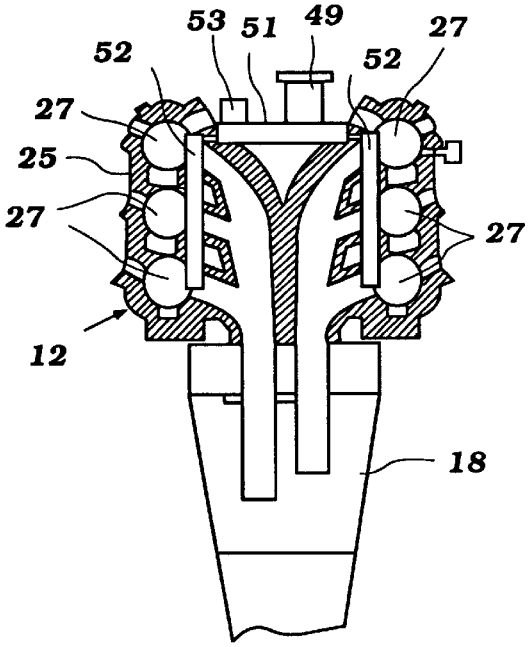
Figure 1C:
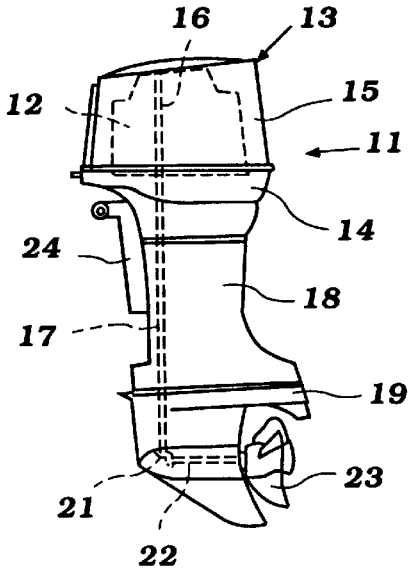
Figure 2:
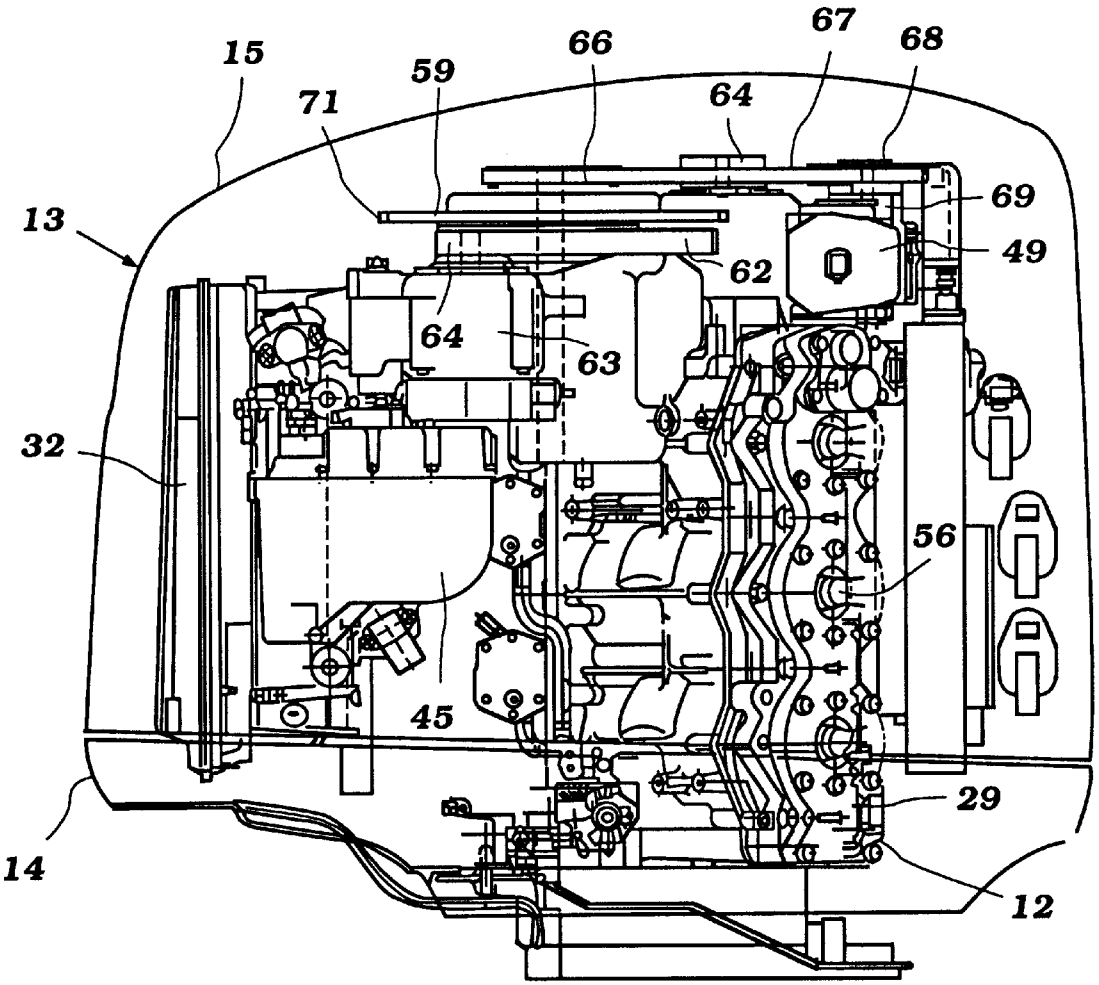

FIG. 2 is a view looking in the same direction as View C of FIG. 1, but shows only the power head with the protective cowling shown in outline so as to illustrate the engine and accessories associated with it in more detail.

Figure 3:
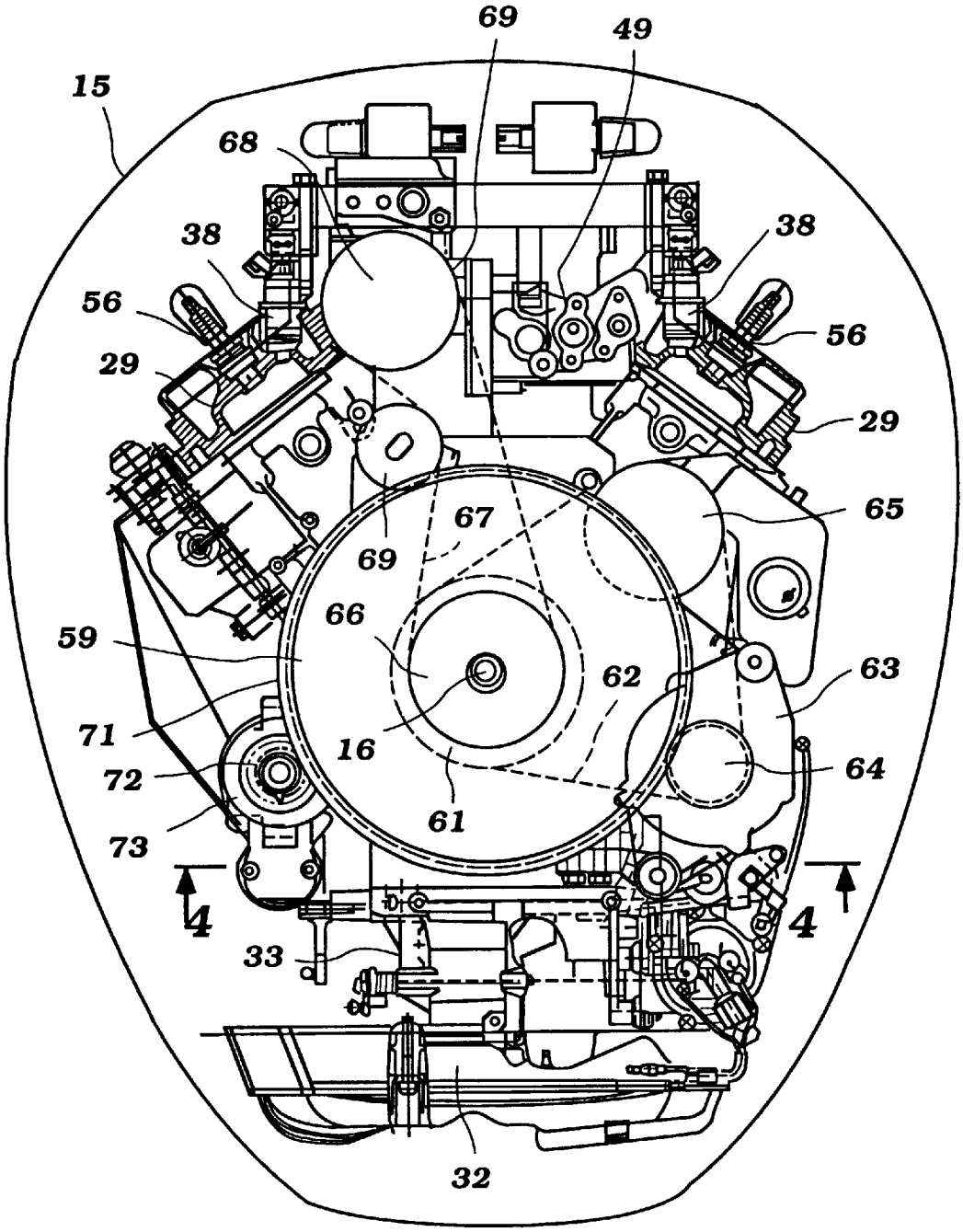

FIG. 3 is a top plan view of the engine of the power head showing the engine in the same orientation as View A of FIG. 1 again illustrating the protective cowling in outline and with portions of the engine broken away so as to more clearly show the internal construction.

Figure 4:
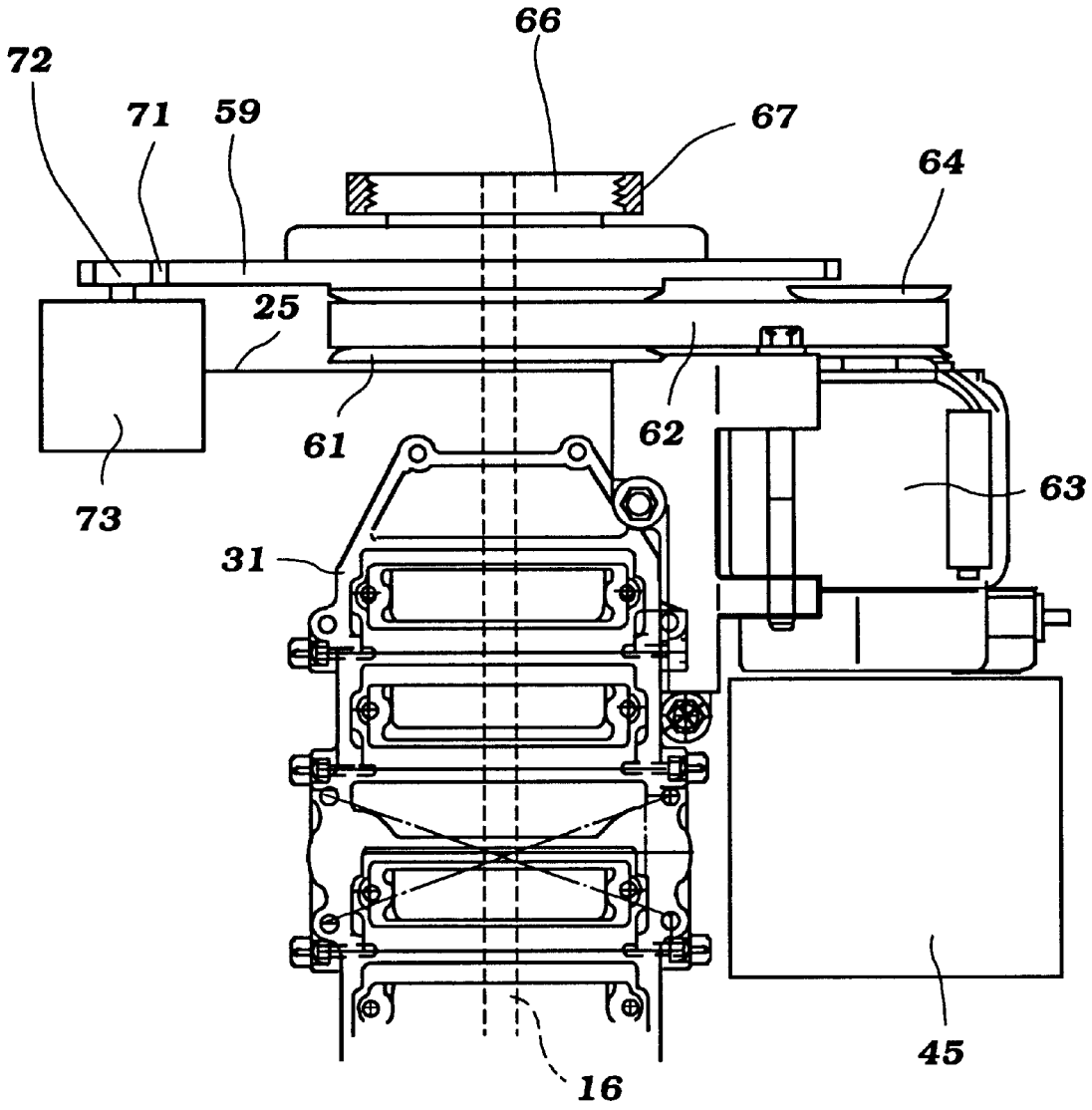

FIG. 4 is an enlarged partial cross-sectional view of the upper portion of the engine and taken along the line 4—4 of FIG. 3.

DETAILED DESCRIPTION OF THE PREFERRED EMBODIMENT

Referring now in detail to the drawings and initially to FIG. 1(*c*), an outboard motor constructed in accordance with an embodiment of the invention is identified generally by the reference numeral 11. The general overall construction of the outboard motor 11 may be of any conventional type and, as should be apparent from the foregoing description, the invention deals primarily with an internal combustion engine 12, which forms a portion of the power head, indicated generally by the reference numeral 13, of the outboard motor. More specifically, the invention deals with the manner in which certain accessories for the engine 12 are driven. However, in order to permit those skilled in the art to understand the environment in which the invention is practiced, the overall construction of the outboard motor 11 will be described generally.

The power head 13 includes, in addition to the engine 12, a protective cowling that is comprised of a lower tray portion 14 to which a removable upper, main cowling portion 15 is detachably connected in a manner known in the art.

As is conventional outboard motor practice, the engine 12 is mounted in the power head 13 so that its crankshaft 16 rotates about a vertically disposed axis. This is to facilitate connection of the crankshaft 16 to a driveshaft 17 which depends into and is journaled within a driveshaft housing 18 positioned beneath the power head 13.

The driveshaft 17 continues into a lower unit 19 which forms a portion of a driveshaft housing and lower unit assembly. A transmission 21 is provided in the lower unit 19 for selectively driving a propeller shaft 22 to which a watercraft propulsion device such as a propeller 23 is affixed. This provides a propulsion force for the watercraft with which the outboard motor 11 is associated.

The outboard motor 11 also includes a mechanism, which may include a swivel bracket 24, for connection to the associated watercraft hull. As is also typical with outboard motor practice, this attachment may provide for tilt and trim movement of the outboard motor 11 relative to the associated watercraft hull and for steering movement about a vertically extending steering axis. As has been noted, this structure may be of any conventional type as is true with the general construction as thus far described.

The construction of the engine 12 will be described particularly by reference to FIGS. 1(*a*) and 1(*b*), details of the construction also appear in the remaining figures. In the illustrated embodiment, the engine 12 is depicted as being of a two-cycle, crankcase compression type having six cylinders arranged in a V orientation. It should be apparent, however, that the invention can be utilized with a wide variety of engine types and engines having other numbers of cylinders and other cylinder configurations. Also, the invention can be utilized with four cycle engines. However, the invention has particular utility with multiple cylinder engines for the reasons aforenoted.

The engine 12 is comprised of a cylinder block 25 which has a pair of cylinder banks that are disposed as a V angle which diverges rearwardly in the power head 13. Cylinder bores 26 are formed in each cylinder bank of the cylinder block 25 and receive respective pistons 27 that reciprocate therein. The pistons 27 are connected by means of connecting rods 28 to the throws of the crankshaft 16 in a manner that is well known in this art. The pistons 27, cylinder bores 26 and cylinder head assemblies 29, that are affixed to each of the cylinder banks in a known manner, form the combustion chambers of the engine.

The crankcase 16 rotates within a crankcase chamber that is formed by the skirt of the cylinder block 25 and a crankcase member 31 that is detachably connected thereto. This crankcase chamber is divided into individual sealed compartments each of which is associated with a respective one of the cylinder bores 26 in a manner well known in the two cycle engine art.

An intake charge is delivered to these crankcase chambers by an induction system which is shown schematically in FIG. 1(*a*) and which appears partially in FIGS. 2 and 3. This induction system includes an air inlet device 32 which may be configured to provide silencing for the inducted air. This air is drawn from within the protective cowling 15 in a manner well known in the outboard motor art. The main cowling member 15 and/or tray 14 may be formed with a suitable air inlet so that atmospheric air can enter into the interior of the protective cowling. Preferably, this inlet is designed in such a way so as to minimize the possible ingestion of water particles into the interior of the protective cowling of the power head 13.

The air inlet device 32 supplies the inducted air to throttle bodies 33 which are disposed on the crankcase member 31 at the front of the power head 13. Throttle valves 34 mounted in the throttle bodies 33 are controlled by a suitable linkage system for controlling the speed at which the engine 12 operates.

The throttle bodies 33 communicate with the runners 35 of an intake manifold so as to supply the air charge to the aforenoted crankcase chamber sections. Reed-type check valves 36 are disposed at the ends of the manifold runners where they communicate with intake ports 37 for delivering the air charge to these crankcase chamber sections.

The reed type check valves 36 operate, in a manner well known in the art, so as to permit the air charge to flow into the crankcase chamber sections when the pistons 27 are moving upwardly in the cylinder bores 26. As the pistons begin their downward stroke, however, the reed type check valve 36 will close so as to permit the charge to be compressed in the crankcase chamber sections without escape therefrom.

Upon continued downward movement of the pistons 27, scavenge ports (not shown) will open to communicate the crankcase chamber sections with the combustion chambers in a manner well known in this art. The charge is then transferred to the combustion chambers for further compression therein.

Fuel is mixed with this compressed air charge for providing the motive power for engine 12. This fuel is sprayed directly into the combustion chambers by fuel injectors 38 that are mounted in the cylinder head assemblies 29 and discharge directly into the combustion chambers. These fuel injectors 38 are supplied with fuel under pressure by a fuel supply system, shown best in FIG. 1(*a*), where the components are illustrated primarily in a schematic fashion. Certain of these components appear in the remaining figures as their actual parts, and are identified by the same reference numerals.

The fuel supply system includes a remotely positioned fuel tank 39 which generally is located in the hull of the associated watercraft. A priming pump 41 delivers fuel to a conduit 42 which has a quick disconnect connection to the power head 13, and specifically to a fuel filter 43 positioned therein.

The fuel filter 43 filters fuel that is drawn by a low-pressure pump or pumps 44. These pumps 44 may be driven by the pressure variation in the crankcase chamber sections, or in some other manner, from the engine. The pumped fuel is then delivered to a vapor separator assembly 45 that is mounted within the power head 13 and enclosed by the protective cowling portion 15.

A uniform level of fuel is maintained in the vapor separator 45 by a float-operated valve 46 that controls the admission of fuel to the vapor separator 45. A low-pressure, electrically driven fuel pump 47 is mounted in this vapor separator and collects the fuel and delivers it to a pressure feed line 48. The pressure feed line 48, in turn, communicates with the inlet side of a high-pressure pump 49. The high-pressure pump 49 is preferably of the plunger or piston type, and is driven from the engine crankshaft 16 in a manner which will be described later.

The pressure at which fuel is supplied to the high-pressure pump 49 is controlled by a low-pressure stage regulator 51 that is provided in the line 48 and which regulates the delivery pressure by dumping excess fuel back to the vapor separator 45.

The high-pressure pump 49, in turn, delivers fuel under pressure to a main fuel manifold 51, which preferably is located in the valley between the cylinder banks. The main fuel manifold 51, in turn, communicates with fuel rails 52, each of which is associated with the fuel injectors 38 associated with a respective of the cylinder banks.

A high-pressure regulator 53 is provided in communication with the main fuel manifold 51. This regulates the pressure delivered to the injectors 38 by dumping fuel back to the vapor separator through a return line 54. A heat exchanger 55, or fuel cooler, is provided in this return line for controlling the temperature of the fuel and maintaining it at the desired temperature, to further ensure against vapor being present in the fuel system.

The fuel is injected directly into the combustion chambers, as aforenoted, by the injectors 38. The specific fuel control system and strategy therefor may be of any known type. This fuel mixes with the compressed air and then is ignited by spark plugs 56 that are mounted in the cylinder head assemblies 29. These spark plugs 56 are fired by a suitable ignition system in accordance with any desired timing program.

Before leaving FIG. 1, one additional system will be described. The engine 12 is provided with a lubricating system that includes a lubricant manifold 57 that supplies fuel to lubricant injectors 58 in a controller manner. These injectors 58 spray into the intake manifold runners 35 or, alternatively, deliver lubricant to the moving components of the engine for direct lubrication. Any type of lubricating system may be employed, and this is controlled, like the fuel injectors 38 and spark plugs 56, by a suitable control in accordance with any desired strategy.

The actual physical relationship of certain of the engine components, and specifically, certain accessories associated therewith will now be described by primary reference to FIGS. 2–4.

As has been noted, the crankshaft 16 rotates about a vertically extending axis. A flywheel assembly 59 is fixed for rotation with the crankshaft 16 at a point above the upper end of the cylinder block 25 and crankcase member 31. This flywheel assembly 59 may also include a flywheel magneto which generates electricity for the ignition system and provides certain timing pulses associated therewith.

This flywheel assembly 51 is disposed slightly above the upper face of the cylinder block 25 so as to accommodate a drive pulley 61 which, in turn, drives a drive belt 62. An engine accessory, such as an alternator 63, is driven by this drive belt 62 via a further pulley 64 that is affixed to the alternator shaft. The alternator 63 is mounted on one side of the crankcase member and adjacent one bank of the cylinder block 25 so as to be located in a convenient and yet out-of-the-way place.

An idler pulley 65 is mounted on this cylinder block 25 so as to provide the appropriate drive and also so as to facilitate tensioning of the drive belt 62.

Mounted above the flywheel 56 and connected for rotation with the crankshaft 16 is a high pressure fuel pump drive pulley 66 which drives a toothed drive belt 67. This drive belt 67 in turn drives a high-pressure fuel pump drive pulley 68. This drive pulley 68 is connected to the input shaft of a pump drive transmission housing 69 that contains an appropriate transmission for driving the high-pressure pump 49 of the fuel injection system.

It is desirable to maintain the high-pressure pump 49 at a relatively high area, and also to provide the fuel lines to and from it at a high area so as to permit automatic purging of the air from the system upon start-up. Also, this critical belt 67 can be conveniently replaced if necessary, without removing any other components. An idler pulley 69 is also mounted at an upper portion of the engine for tensioning the drive belt 67.

The flywheel 59 is provided with a ring gear 71 on its outer periphery. A pinion gear 72 of a starter motor 73 is engaged with this ring gear 71 for electric starting of the engine.

Thus, it may be seen that all of the accessories associated with and driven by or for the crankshaft 16 are mounted at a high location where they can be easily serviced, and yet the overall height of the engine is maintained relatively low. Also, this arrangement facilitates servicing of the high-pressure drive belt 67 without removal of other components.

Of course, the foregoing description is that of a preferred embodiment of the invention, and various changes and modifications may be made without departing from the spirit and scope of the invention, as defined by the appended claims.

What is claimed is:

1. An outboard motor having a power head containing a powering internal combustion engine, a driveshaft housing and lower unit depending from said power head and containing a driveshaft driven by a crankshaft of said engine, a transmission driven by said driveshaft and a propulsion device driven by said transmission for propelling an associated watercraft, said engine being mounted in said power head so that the said crankshaft rotates about a vertically extending axis, a flywheel affixed to the upper end of said crankshaft within said power head, a high pressure pump driven off of said crankshaft at a point above said flywheel, and another engine accessory driven off of said crankshaft at the upper end of the engine but below said flywheel.

2. An outboard motor as set forth in claim 1, wherein at least one of the high pressure pump and the other engine accessory is driven by a flexible transmitter.

3. An outboard motor as set forth in claim 2, wherein both of the high pressure pump and the other engine accessory are driven by flexible transmitters.

4. An outboard motor as set forth in claim 1, wherein the high pressure pump is driven by a flexible transmitter and a driving pulley fixed to the flywheel.

5. An outboard motor as set forth in claim 1, further including a ring gear fixed to the flywheel and a starter motor carried by the engine and having a pinion gear drivingly related to said ring gear.

6. An outboard motor as set forth in claim 5, wherein at least one of the high pressure pump and the other engine accessory is driven by a flexible transmitter.

7. An outboard motor as set forth in claim 6, wherein both of the high pressure pump and the other engine accessory are driven by flexible transmitters.

8. An outboard motor as set forth in claim 5, wherein the high pressure pump is driven by a flexible transmitter and a driving pulley fixed to the flywheel.

9. An outboard motor as set forth in claim 1, wherein the high pressure pump delivers fuel to a plurality of fuel injectors each of which injects fuel directly into a combustion chamber of the engine.

10. An outboard motor as set forth in claim 9, wherein at least one of the high pressure pump and the other engine accessory is driven by a flexible transmitter.

11. An outboard motor as set forth in claim 10, wherein both of the high pressure pump and the other engine accessory are driven by flexible transmitters.

12. An outboard motor as set forth in claim 9, wherein the high pressure pump is driven by a flexible transmitter and a driving pulley fixed to the flywheel.

13. An outboard motor as set forth in claim 9, further including a ring gear fixed to the flywheel and a starter motor carried by the engine and having a pinion gear drivingly related to said ring gear.

14. An outboard motor as set forth in claim 13, wherein at least one of the high pressure pump and the other engine accessory is driven by a flexible transmitter.

15. An outboard motor as set forth in claim 14, wherein both of the high pressure pump and the other engine accessory are driven by flexible transmitters.

16. An outboard motor as set forth in claim 13, wherein the high pressure pump is driven by a flexible transmitter and a driving pulley fixed to the flywheel.

* * * * *